US009212340B2

(12) United States Patent
Vauthrin et al.

(10) Patent No.: US 9,212,340 B2
(45) Date of Patent: Dec. 15, 2015

(54) POLYMER-CLEANING COMPOSITION

(75) Inventors: Mélanie Vauthrin, Innenheim (FR); Bernard Monguillon, Arbonne (FR); Paul Guillaume Schmitt, Lescar (FR)

(73) Assignee: ARKEMA FRANCE, Colombes (FR)

( * ) Notice: Subject to any disclaimer, the term of this patent is extended or adjusted under 35 U.S.C. 154(b) by 58 days.

(21) Appl. No.: 13/877,548

(22) PCT Filed: Oct. 4, 2011

(86) PCT No.: PCT/FR2011/052309

§ 371 (c)(1),
(2), (4) Date: Jun. 27, 2013

(87) PCT Pub. No.: WO2012/045971

PCT Pub. Date: Apr. 12, 2012

(65) Prior Publication Data

US 2013/0310297 A1 Nov. 21, 2013

(30) Foreign Application Priority Data

Oct. 5, 2010 (FR) ..... 10 58050

(51) Int. Cl.

| | |
|---|---|
| ***C11D 3/30*** | (2006.01) |
| ***C11D 3/34*** | (2006.01) |
| ***C11D 3/43*** | (2006.01) |
| ***C11D 3/44*** | (2006.01) |
| ***C11D 7/50*** | (2006.01) |
| ***C11D 3/20*** | (2006.01) |
| ***C11D 7/32*** | (2006.01) |
| ***C11D 7/34*** | (2006.01) |
| ***C11D 11/00*** | (2006.01) |

(52) U.S. Cl.

CPC ..... *C11D 7/5009* (2013.01); *C11D 3/2003* (2013.01); *C11D 3/2068* (2013.01); *C11D 3/2093* (2013.01); *C11D 3/30* (2013.01); *C11D 3/3445* (2013.01); *C11D 7/3209* (2013.01); *C11D 7/3218* (2013.01); *C11D 7/3227* (2013.01); *C11D 7/34* (2013.01); *C11D 11/0041* (2013.01)

(58) Field of Classification Search

CPC .. C11D 3/2003; C11D 2/2068; C11D 3/2093; C11D 3/30; C11D 3/3445; B08B 3/04

USPC ..... 510/175, 176, 245, 255, 258, 264, 274, 510/493, 499, 505, 243; 134/34, 39

See application file for complete search history.

(56) References Cited

U.S. PATENT DOCUMENTS

| | | | | |
|---|---|---|---|---|
| 6,367,486 | B1 | 4/2002 | Lee et al. | |
| 6,475,966 | B1 | 11/2002 | Sahbari | |
| 2002/0037820 | A1* | 3/2002 | Small et al. | 510/175 |
| 2003/0104960 | A1 | 6/2003 | Opre | |
| 2003/0130149 | A1 | 7/2003 | Zhou et al. | |
| 2004/0259761 | A1 | 12/2004 | Yokoi et al. | |
| 2005/0202987 | A1* | 9/2005 | Small et al. | 510/175 |
| 2010/0104824 | A1 | 4/2010 | Phenis et al. | |
| 2010/0242999 | A1 | 9/2010 | Quillen et al. | |

OTHER PUBLICATIONS

International Search Report for International Application No. PCT/FR2011/052309 dated Mar. 15, 2012.

* cited by examiner

*Primary Examiner* — Gregory R Delcotto
(74) *Attorney, Agent, or Firm* — Ratnerprestia

(57) ABSTRACT

The present disclosure relates to a dimethyl sulfoxide composition suitable for cleaning polymer residue found on the devices used for processing plastic materials, in particular polyurethane.

21 Claims, No Drawings

POLYMER-CLEANING COMPOSITION

CROSS REFERENCE TO RELATED APPLICATIONS

This application is the U.S. National Phase application of PCT International Application No. PCT/FR2011/052309, filed Oct. 4, 2011, and claims priority to French Patent Application No. 1058050, filed Oct. 5, 2010, the disclosures of which are incorporated by reference in their entirety for all purposes.

FIELD OF THE INVENTION

The present invention relates to the field of the transformation of plastics, more specifically the field of molding, injection, injection-molding, extrusion, extrusion-molding, and other techniques for transforming plastics.

More specifically, the invention relates to the cleaning of various devices used in plastic-transforming industries. These devices are, for example, molds, injection nozzles, extrusion screws and, generally, all the parts, which are most commonly but not necessarily metal parts, that come to more or less extended contact with one or more plastics brought to more or less high temperatures and cooled in order to enable them to be transformed.

BACKGROUND OF THE INVENTION

During transformation operations, such as molding of articles or objects made of plastic, polymer residues of various shapes and of more or less large sizes, can remain in contact with the mold. In particular, during demolding, when the molds are opened, polymer residues can be torn away from the object molded and can adhere to the walls of the mold.

The same is true in extrusion screws, injection nozzles, and any of the parts of transformation devices which come into contact with plastics. It is imperative to clean, i.e. to eliminate, all these residues adhering to the molds, screws, nozzles and the like, in order to be able to perform further subsequent molding, operations, extrusion operations, and the like.

These cleaning operations aimed at removing the polymer residues are most commonly carried out today by bringing said residues into contact with one or more solvents or mixtures of solvents.

These solvents are most commonly organic solvents, some of which are foul-smelling, more or less toxic and damaging to the environment, but also especially toxic and harmful to the users responsible for cleaning said polymer residues.

Many of these solvents are today banned, or are going to be banned, either by government directives, or directly through the determination of the manufacturers themselves, worried about preserving the health of their employees.

For example, it is known that molds used for manufacturing polyurethane objects are generally cleaned with dimethylformamide (DMF) which is today considered to be harmful and toxic.

Thus, a first objective of the present invention is to provide novel polymer-residue-cleaning products, formulations and compositions which are less toxic and less harmful than the solvents used today, or even residue-cleaning products, formulations and compositions which are not toxic and not harmful to the environment and to users.

Another objective of the present invention is to provide polymer-residue-cleaning products, formulations and compositions which are more efficient than the solvents known and used today.

Other further objectives will emerge during the description of the present invention which follows.

SUMMARY OF THE INVENTION

One aspect of the present invention relates to a composition comprising:

from 40% to 95% of dimethyl sulfoxide (DMSO);
from 1% to 60% of at least one amine;
from 0% to 30% of water; and
from 0% to 10% of at least one additive.

Another aspect of the present invention relates to a composition comprising:

from 40% to 95% of a mixture of dimethyl sulfoxide (DMSO) and at least one non-nitrogenous solvent chosen from alcohols, ethers, and esters;
from 1% to 60% of at least one amine;
from 0% to 30% of water; and
from 0% to 10% of at least one additive.

Yet another aspect of the present invention relates to process for partially or totally dissolving a polymer, comprising bringing the polymer into contact with the composition, wherein the composition comprises:

from 40% to 95% of dimethyl sulfoxide (DMSO);
from 1% to 60% of at least one amine;
from 0% to 30% of water; and
from 0% to 10% of at least one additive.

Another aspect of the present invention relates to a process for cleaning polymer residues present on devices used in the transformation of plastics, comprising bringing said device soiled with said polymer residues into contact with at least one composition at a temperature of ranging from ambient temperature to 90° C., wherein said composition comprises:

from 40% to 95% of dimethyl sulfoxide (DMSO);
from 1% to 30% of at least one amine;
from 0% to 30% of water; and
from 0% to 10% of at least one additive.

DETAILED DESCRIPTION OF THE INVENTION

It has now been found that it is possible at least partially, or even completely, to achieve the abovementioned objectives by using, as polymer-cleaning composition, a mixture comprising dimethyl sulfoxide (DMSO) and at least one amine.

The composition of the invention comprises, and according to a preferred aspect consists of, DMSO and at least one amine, with optionally water and/or at least one additive.

More specifically, the present invention relates to a composition comprising, and preferably consisting of:

from 40% to 95% of dimethyl sulfoxide (DMSO);
from 1% to 60% of at least one amine;
from 0% to 30% of water; and
from 0% to 10% of at least one additive.

In the description of this invention, all the percentages are expressed by weight, unless otherwise explicitly mentioned.

DMSO is a solvent considered to be nonharmful and nontoxic. In addition, it can be available in various degrees of purity. DMSO of high purity has virtually no odor, or at the very least no nauseating odor. According to one variant, the DMSO used can be advantageously odorized with at least one odorant.

According to one preferred embodiment, the composition according to the invention comprises, and preferably consists of:

from 50% to 95%, preferably from 60% to 97%, of dimethyl sulfoxide (DMSO);

from 1% to 30%, preferably from 2% to 20%, of at least one amine;

from 0% to 30% of water, preferably from 0% to 15%; and from 0% to 10%, preferably from 0% to 5%, of at least one additive.

The amine(s) present in the composition of the invention can be of any type known to those skilled in the art. However, primary, secondary or tertiary amines with a molecular weight of less than 500 daltons, preferably less than 300 daltons, or preferably even less than 200 daltons, more particularly preferably less than 100 daltons, are preferred. Primary or secondary amines are preferred, primary amines being most particularly preferred.

Amines comprising a single amine function are preferred. Amines also comprising at least one oxygen atom, and preferably one or two oxygen atoms, are also preferred.

In at least one embodiment, amines comprising one or two groups chosen from hydroxyalkyl and alkoxyalkyl, where alkyl represents methyl, ethyl, propyl or butyl, are still further preferred. Most particularly preferred are amines comprising one or two hydroxyethyl groups and/or a methoxy group. Amines bearing one or two hydroxyethyl groups are the most preferred.

By way of nonlimiting examples, the amines which can be advantageously used in the compositions according to the invention are chosen from alkylalcanolamines, alkyldialcanolamines and alkoxyamines.

According to one embodiment, and among the amines which are usable in the compositions of the invention, mention may be made, by way of nonlimiting examples, of monoethanolamine (MEoA), diethanolamine (DEoA), propanolamine (PoA), butyl-iso-propanolamine (BiPoA), isopropanolamine (iPoA), 2-[2-(3-aminopropoxy)ethoxy] ethanol, N-2-hydroxyethyldiethylenetriamine, (3-methoxy) propylamine (MoPA), 3-isopropoxypropylamine (IPOPA) and triethylamine (TEA).

According to one most particularly preferred aspect, the compositions according to the invention comprise at least one amine chosen from monoethanolamine (MEoA), diethanolamine (DEoA), propanolamine (PoA) and (3-methoxy)propylamine (MoPA), more preferably from monoethanolamine (MEoA) and diethanolamine (DEoA).

In addition to the DMSO and at least one amine, such as they have just been defined, the presence of an amount of water in the compositions of the invention has proved to be advantageous for enabling even more efficient dissolution of polymer residues.

Moreover, the presence of water in the compositions of the invention has the additional advantage of lowering the crystallization point of said compositions.

Thus, and according to yet another aspect, the present invention relates to a composition comprising, and preferably consisting of:

from 40% to 95% of dimethyl sulfoxide (DMSO);

from 1% to 60% of at least one amine;

from 1% to 30% of water; and from 0% to 10% of at least one additive.

In one preferred embodiment, the present invention relates to a composition comprising, and preferably consisting of:

from 50% to 95%, preferably from 60% to 97%, of dimethyl sulfoxide (DMSO);

from 1% to 30%, preferably from 2% to 20%, of at least one amine;

from 1% to 30% of water, preferably from 1% to 15%; and from 0% to 10%, preferably from 0% to 5%, of at least one additive.

Finally, the compositions according to the present invention can comprise one or more additives commonly used in the field. These additives advantageously do not have specific or intrinsic polymer-cleaning or polymer-dissolving properties. Among the additives which can be present in the compositions according to the invention, mention may be made, by way of nonlimiting examples, of corrosion inhibitors, antioxidants, dyes, aromas and other odor-masking agents, stabilizers, wetting agents, and the like.

Among the corrosion inhibitors, mention may be made of catechol, sodium tolyltriazolate and morpholine, for example.

A particularly preferred composition for cleaning polymer residues according to the present invention comprises, and preferably consists of, from 80% to 90% of DMSO, from 2% to 9% of MEoA and from 5% to 15%, for example approximately 8%, of water. This composition can also comprise from a few ppm by weight to 1% of a corrosion inhibitor.

According to yet another aspect, the compositions of the present invention can comprise, instead of the DMSO, a mixture of DMSO and at least one other non-nitrogenous solvent. Among the non-nitrogenous solvents, mention may be made, by way of nonlimiting examples, of alcohols, ethers, esters, and other nonnitrogenous solvents compatible with the compositions such as they have just been described.

Among the nonnitrogenous additional solvents that can form a mixture with DMSO present in the compositions of the present invention, preference is given to monofunctional and/or difunctional esters, and more particularly alkyl esters, where "alkyl" denotes a linear or branched hydrocarbon-based chain comprising from 1 to 6 carbon atoms. These esters advantageously originate from linear-chain or branched-chain monocarboxylic and/or dicarboxylic acids comprising from 3 to 30 carbon atoms.

Most particularly preferred are methyl, ethyl, propyl and butyl esters of formic acid, acetic acid, propionic acid, butyric acid, maleic acid, succinic acid, glutaric acid, 2-methylglutaric acid, and the like, and also mixtures thereof in any proportions.

Thus, in one preferred embodiment, the invention relates to a composition comprising, and preferably consisting of:

from 50% to 95%, preferably from 60% to 97%, of a dimethyl sulfoxide (DMSO)/non-nitrogenous solvent mixture, said non-nitrogenous solvent being chosen from alcohols, ethers and esters;

from 1% to 30%, preferably from 2% to 20%, of at least one amine;

from 0% to 30% of water, preferably from 0% to 15%; and from 0% to 10%, preferably from 0% to 5%, of at least one additive.

According to another preferred embodiment, the invention relates to a composition comprising, and preferably consisting of:

from 50% to 95%, preferably from 60% to 97%, of a dimethyl sulfoxide (DMSO)/non-nitrogenous solvent mixture, said non-nitrogenous solvent being chosen from alcohols, ethers and esters;

from 1% to 30%, preferably from 2% to 20%, of at least one amine;

from 1% to 30% of water, preferably from 1% to 15%; and from 0% to 10%, preferably from 0% to 5%, of at least one additive.

In the compositions according to the invention which comprise a DMSO/non-nitrogenous solvent mixture, preference is given to those for which the DMSO/non-nitrogenous solvent weight ratio is between 99/1 and 30/70, preferably between 90/10 and 40/60, for example the weight ratio is approximately 50/50.

The compositions of the invention can be prepared according to any method known in the field, and for example by simple mixing of the various ingredients in any order. However, it is preferred to add the amines to the DMSO/water mixture, when said water is present in the composition. The optional additives are advantageously added to the final mixture of DMSO/amine(s) and optionally water.

According to another aspect, a subject of the present invention is the use of at least one of the compositions such as they have just been defined, for partially or totally dissolving polymers, and in particular for cleaning polymer residues.

The term "cleaning polymer residues" is intended to mean the partial or total dissolution of polymers with the compositions of the present invention.

The polymers which can thus be partially or totally dissolved are of any type, thermoplastic and thermosetting, in particular thermoplastic.

The polymers targeted in the use of the present invention are, for example, chosen, in a nonlimiting manner, from fluoropolymers, such as poly(vinyl difluoride) or PVDF, nitrogenous polycondensates, such as those bearing amide, imide, amido-amide, urethane or nitrile groups, sulfur-containing polycondensates, such as those bearing sulfone groups, and the like.

The compositions of the invention are particularly suitable for cleaning polymers chosen from polyurethanes, polyamides, polyamide-imides, polyethersulfones, polyacrylonitriles, and the like, and more particularly suitable for dissolving, for cleaning, polyurethanes.

The compositions of the invention are most particularly effective for cleaning polyurethane residues for which the solvent of choice to date was DMF, which is now prohibited, in particular by the European guidelines.

For cleaning polymer residues, the compositions of the present invention are used in a temperature range from ambient temperature to 90° C. The efficiency of the compositions according to the invention decreases rapidly when the temperature decreases, and, below ambient temperature, the time required for efficient cleaning can prove to be relatively long. Above 90° C., the cleaning composition can generate unpleasant vapors, but it is possible to work in a ventilated or closed chamber, thus making it possible to work at the boiling point of the cleaning composition.

However, it is preferred to use the compositions according to the invention at a temperature of between 30° C. and 70° C., for example between 50° C. and 65° C.

According to yet another aspect, the present invention relates to a process for cleaning polymer residues present on devices used in the transformation of plastics as previously defined, said process comprising at least one step of bringing the said device soiled with said polymer residues into contact with at least one composition according to the present invention, under the temperature conditions indicated above.

The term "bringing into contact" is intended to mean partial or total immersion of the device to be cleaned, with or without agitation, or spraying the device to be cleaned with a cleaning composition at various pressures, for example by means of a spray gun or brush, and the like. As a variant, the bringing into contact can simply be wiping with a cloth, a sponge or any other absorbing/desorbing material soaked in the cleaning composition.

The bringing into contact defined above can optionally be accompanied by physical cleaning, for example using tools, such as spatulas, scrapers, and the like.

The present invention is now illustrated by means of the examples which follow, which are in no way limiting in nature, and which consequently cannot be understood to be capable of restricting the scope of the invention as claimed.

EXAMPLE 1

Dissolution of Polyurethane (PU) Using DMF and DMSO

Polyurethane residues originating from shoe sole molds were used to carry out the tests illustrating the invention.

The reference solvent is DMF. To clean the molds, the molds are usually immersed for a few hours in a bath of DMF brought to 60° C.

The tests are in this case carried out in 20 ml glass flasks. 10 ml of the cleaning composition (e.g., DMF or DMSO alone) preheated in an incubator to approximately 60° C. are placed in each flask. A sample of polyurethane (PU) having a parallelepipedal shape (approximately 10×5×2 mm) is then placed in each flask. The flasks are closed and left, without agitation, in an incubator at 60° C.

Swelling of the samples is first of all observed after approximately 2 to 3 minutes of immersion. After 25 minutes, the PU is not dissolved in either the DMF or the DMSO. The difference in efficiency between the DMF and the DMSO is observed in the time: after 18 hours at 60° C., the PU begins to become soluble in the DMF, whereas nothing happens in the DMSO. DMF is therefore more effective than DMSO alone.

EXAMPLE 2

Dissolution of Polyurethane (PU) in a DMSO/Nonnitrogenous Solvent Mixture

The same protocol as in example 1 is repeated using a mixture of DMSO (95.5%) and diacetone alcohol (4.5%). As in DMSO, swelling of the PU is observed in the DMSO/diacetone alcohol mixture, but no dissolution, even after 18 hours of immersion of the sample.

A comparable test was carried out with a DMSO/hexylene glycol mixture. Likewise, it is observed that the hexylene glycol provides no additional efficiency. This mixture acts like DMSO and is less efficient than DMF.

The addition of a non-nitrogenous, oxygen-containing solvent to DMSO does not make it possible to improve the efficiency of DMSO alone and remains a less effective solution than dissolution with DMF.

EXAMPLE 3

Dissolution of Polyurethane (PU) in a DMSO/MEoA Mixture

The same protocol as in example 1 is repeated using a mixture of DMSO (95.5%) and monoethanolamine (4.5%), with immersion for 18 hours at 60° C.

It is observed, surprisingly, that the PU sample is completely dissolved in the DMSO/MEoA mixture, whereas, in DMF, the sample barely begins to dissolve.

A DMSO/MEoA mixture is therefore much more efficient than DMF alone.

EXAMPLE 4

Dissolution of Polyurethane (PU) in a DMSO/MEoA Mixture, with and without the Addition of Water The same protocol as in example 1 is repeated while comparing a DMSO/MEoA (95.5%/4.5%) composition and a DMSO/MEoA/water (87.5%/4.5%/8%) composition.

After 4 h at 60° C., the PU is completely dissolved in the DMSO/MEoA/water mixture, whereas it is not dissolved in the DMSO/MEoA (95.5%/4.5%) mixture.

A DMSO/MEoA/water mixture is therefore much more efficient than a DMSO/MEoA mixture.

EXAMPLE 5

Influence of the Proportion of Nitrogenous Solvent in the DMSO on the Dissolution of Polyurethane (PU)

Still according to the protocol described in example 1, PU-sample dissolution tests are carried out while varying the concentration of MEoA in the DMSO, from 1% to 5%.

It is observed that the greater the amount of MEoA in the DMSO, the faster the dissolution of the PU.

In addition, the DMSO+1% MEoA mixture is more efficient than DMF alone, since flakes of PU in suspension in the mixture have already begun to be seen after 1 hour at 60°, whereas no effect (other than swelling of the sample) is observed in either DMF or DMSO.

After 48 hours at 60° C., the PU is completely dissolved in the DMSO+1% MEoA mixture. The addition of MEoA to DMSO (from 1% to 5%) clearly increases the dissolution of PU compared with DMSO alone. The DMSO+MEoA mixture is more efficient than DMF.

EXAMPLE 6

Lowering of the Crystallization Point in the Presence of Water in the DMSO-Based Cleaning Compositions The crystallization point of DMSO is 18.5° C., which often poses storage and handling problems during winter.

The crystallization point of a DMSO (95%)+MEoA (5%) mixture is approximately 15° C. This crystallization point can be further enhanced by adding water to the composition.

A test is carried out by adding 8% by weight of water to DMSO, and then the MEoA is added (5% by weight in the above mixture). The crystallization point of this mixture is measured at −2.9° C., whereas a DMSO/water (92%/8%) mixture has a crystallization point close to 0° C.

According to the protocol of the example, dissolution tests are carried out on this DMSO/MEoA/water (i.e. 87.6%/4.8%/7.6%) mixture.

After 3 hours at 60° C., the PU sample is completely dissolved in this mixture, whereas it is only beginning to be dissolved in the DMSO/MEoA (95%/5%) mixture and no dissolution is observed in DMF: the addition of water to the DMSO/MEoA mixture accelerates the dissolution of PU.

EXAMPLE 7

Influence of the Water Content on the Dissolution of Polyurethane (PU) in a DMSO/MEoA/Water Mixture The same protocol as example 1 is repeated while comparing DMSO/MEoA/water compositions with varying water contents.

After 7 hours at 60° C., the results are the following:

91.5% DMSO/4.5% MEoA/4% water: polymer not completely dissolved;

87.5% DMSO/4.5% MEoA/8% water: polymer completely dissolved;

80.5% DMSO/4.5% MEoA/15% water: very beginning of dissolution of the polymer;

70.5% DMSO/4.5% MEoA/25% water: no dissolution of the polymer;

45.5% DMSO/4.5% MEoA/50% water: no dissolution of the polymer.

It can therefore be concluded that a water content up to 15% significantly improves the dissolving efficiency of the DMSO/MEoA/water compositions.

EXAMPLE 8

Dissolution of Polyurethane (PU) in a DMSO/Nonnitrogenous Solvent/MEoA/Water Mixture The same protocol as in example 1 is repeated using a mixture of DMSO (50% by weight) and dimethyl glutarate (50% by weight). As in DMSO, swelling of the PU is observed in the DMSO/dimethyl 2-methylglutarate mixture, but no dissolution, even after 18 hours of immersion of the sample.

A comparable test was carried out with a DMSO/dimethyl 2-methylglutarate/MEoA/water (44.5%-44.5%-3%-8% by weight) mixture. After 18 hours of immersion of the PU sample, the latter is completely dissolved.

The addition of MEoA and of water, under the conditions of the invention, to a DMSO/nonnitrogenous solvent mixture makes it possible to clearly improve the effectiveness compared with the DMSO/nonnitrogenous solvent mixture alone.

The invention claimed is:

1. A composition consisting of:

from 40% to 95% of dimethyl sulfoxide (DMSO);

from 1% to 30% of at least one amine, wherein the at least one amine is selected from primary, secondary, or tertiary amines;

from 5% by weight to 30% of water; and from 0% by weight to 10% of at least one additive, wherein the additive is selected from the group consisting of corrosion inhibitors, antioxidants, dyes, and aromas.

2. The composition according to claim 1, wherein the composition consists of:

from 50% to 95% of dimethyl sulfoxide (DMSO);

from 1% to 30% of at least one amine, wherein the at least one amine is from primary, secondary, or tertiary amines;

from 1% to 30% of water; and from 0% to 10% of at least one additive, wherein the additive is selected from the group consisting of corrosion inhibitors, antioxidants, dyes, and aromas.

3. The composition according to claim 1, wherein the at least one amine is selected from primary, secondary or tertiary amines with a molecular weight of less than 500 daltons.

4. The composition according to claim 1, wherein the at least one amine is selected from primary, secondary or tertiary amines with a molecular weight of less than 300 daltons.

5. The composition according to claim 1, wherein the at least one amine is selected from primary or secondary amines.

6. The composition according to claim 1, wherein the at least one amine comprises a single amine function and at least one oxygen atom.

7. The composition according to claim 1, wherein the at least one amine comprises one or two groups selected from hydroxyalkyl or alkoxyalkyl groups, wherein alkyl represents methyl, ethyl, propyl, or butyl groups.

8. The composition according to claim 1, wherein the at least one amine comprises one or two groups selected from hydroxyethyl or methoxy groups.

9. The composition according to claim 1, wherein the at least one amine is selected from monoethanolamine (MEoA), diethanolamine (DEoA), propanolamine (PoA), butyl-isopropanolamine (BiPoA), iso-propanolamine (iPoA), 2-[2-(3-aminopropoxyl)ethoxy]ethanol, N-2-hydroxyethyldiethylenetriamine, (3-methoxy)propylamine (MoPA), 3-isopropoxypropylamine (IPOPA), or triethylamine (TEA).

10. The composition according to claim 1, wherein the at least one amine is selected from monoethanolamine (MEoA) or diethanolamine (DEoA).

11. The composition according to claim 1, wherein the composition consists of:

from 80% to 90% of dimethyl sulfoxide (DMSO);
from 2% to 9% of monoethanolamine (MEoA);
from 5% to 15% of water; and
optionally up to 1% of a corrosion inhibitor.

12. A composition consisting of:

from 40% to 95% of a mixture of dimethyl sulfoxide (DMSO) and at least one non-nitrogenous solvent selected from alcohols, ethers, or esters;
from 1% to 30% of at least one amine;
from 5% to 30% of water; and
from 0% to 10% of at least one additive, wherein the at least one additive is selected from the group consisting of corrosion inhibitors, antioxidants, dyes, and aromas.

13. The composition according to claim 12, wherein the at least one non-nitrogenous solvent is selected from monofunctional or difunctional esters.

14. The composition according to claim 12, wherein the weight ratio of dimethyl sulfoxide (DMSO) to the at least one non-nitrogenous solvent ranges from 99/1 to 30/70.

15. The composition according to claim 13, wherein the weight ratio of dimethyl sulfoxide (DMSO) to the at least one non-nitrogenous solvent ranges from 90/10 to 40/60.

16. A process for partially or totally dissolving a polymer, comprising bringing the polymer into contact with the composition of claim 1.

17. The process according to claim 16, wherein the polymer is a thermoplastic or thermosetting polymer bearing amide, imide, amido-amide, urethane or nitrile groups.

18. The process according to claim 16, wherein the polymer is a polyurethane.

19. A process for cleaning polymer residues present on a device used in the transformation of plastics, comprising bringing said device soiled with said polymer residues into contact with at least one composition at a temperature of ranging from ambient temperature to 90° C., wherein said composition consists of:

from 40% to 95% of dimethyl sulfoxide (DMSO);
from 1% to 30% of at least one amine;
from 1% to 30% of water; and
from 0% to 10% of at least one additive, wherein the additive is selected from the group consisting of corrosion inhibitors, antioxidants, dyes, and aromas.

20. The process according to claim 19, wherein the device used in the transformation of the plastics is a mold, an injection nozzle, or an extrusion screw.

21. The composition according to claim 1, wherein the composition consists of:

from 40% by weight to 95% of dimethyl sulfoxide (DMSO);
from 1% by weight to 30% of at least one amine, wherein the at least one amine is selected from primary, secondary, or tertiary amines;
from 5% by weight to 15% of water; and
from 0% by weight to 10% of at least one additive, wherein the additive is selected from the group consisting of corrosion inhibitors, antioxidants, dyes, and aromas.

* * * * *